US010538909B2

(12) United States Patent
Dicaire et al.

(10) Patent No.: US 10,538,909 B2
(45) Date of Patent: Jan. 21, 2020

(54) TENSION TIE ASSEMBLY

(71) Applicant: OMG, Inc., Agawam, MA (US)

(72) Inventors: Mark A. Dicaire, Boylston, MA (US); Richard L. Belinda, Westfield, MA (US); Mark J. Guthrie, West Springfield, MA (US); Timothy F. Gillis, Florence, MA (US); R. Timothy Irwin, Lenox, MA (US)

(73) Assignee: OMG, Inc., Agawam, MA (US)

( * ) Notice: Subject to any disclaimer, the term of this patent is extended or adjusted under 35 U.S.C. 154(b) by 0 days.

(21) Appl. No.: 16/393,089

(22) Filed: Apr. 24, 2019

(65) Prior Publication Data

US 2019/0249417 A1 Aug. 15, 2019

Related U.S. Application Data

(63) Continuation-in-part of application No. 15/944,868, filed on Apr. 4, 2018, now abandoned.

(60) Provisional application No. 62/481,914, filed on Apr. 5, 2017.

(51) Int. Cl.

| | |
|---|---|
| ***E04B 1/38*** | (2006.01) |
| ***E04B 1/41*** | (2006.01) |
| ***E04B 1/26*** | (2006.01) |

(52) U.S. Cl.

CPC ..... *E04B 1/40* (2013.01); *E04B 1/2612* (2013.01); *E04B 2001/2616* (2013.01); *E04B 2001/2644* (2013.01)

(58) Field of Classification Search

CPC .. E04B 1/40; E04B 1/2612; E04B 2001/2644; E04B 2001/2616

See application file for complete search history.

(56) References Cited

U.S. PATENT DOCUMENTS

| | | | |
|---|---|---|---|
| 3,914,910 | A | 10/1975 | Struben |
| 4,173,857 | A | 11/1979 | Kosaka |
| 6,311,449 | B1 | 11/2001 | Morse et al. |
| 7,065,932 | B2 | 6/2006 | Roesset et al. |
| 7,356,973 | B2 | 4/2008 | Roesset et al. |

(Continued)

FOREIGN PATENT DOCUMENTS

| | | |
|---|---|---|
| GB | 217038 | 6/1924 |
| JP | 10266346 A | 10/1998 |

(Continued)

OTHER PUBLICATIONS

International Search Report and Written Opinion dated Jul. 27, 2018 (PCT/US2018/025987).

*Primary Examiner* — Patrick J Maestri

(74) *Attorney, Agent, or Firm* — Alix, Yale & Ristas, LLP

(57) ABSTRACT

A tension tie assembly for attachment of a first building member to a second building member under tension. The assembly includes a tie with a ball on one end that attaches to a first anchoring member on the first building member and a threaded stud on the opposite end that attaches to a second anchoring member on the second building member. A cable extends between the ball and the stud. The ball may be retained in a rotatable engagement by the first anchoring member. The force of tension on the tie can be adjusted after attachment to the first and second building members. The adjustability of tension can be provided by a threaded connection between sub-elements of the tie such a nut threaded to the stud.

20 Claims, 15 Drawing Sheets

(56) References Cited

U.S. PATENT DOCUMENTS

| | | | | |
|---|---|---|---|---|
| 8,065,843 | B2 * | 11/2011 | Timothy | F16G 11/12 248/208 |
| 8,555,580 | B2 | 10/2013 | Vilasineekul | |
| 2012/0315081 | A1 | 12/2012 | Bouldin et al. | |

FOREIGN PATENT DOCUMENTS

| | | | |
|---|---|---|---|
| JP | 2001241106 | | 9/2001 |
| WO | 9741317 | A1 | 11/1997 |

* cited by examiner

TENSION TIE ASSEMBLY

CROSS-REFERENCE TO RELATED APPLICATION

This application is a continuation-in-part of U.S. patent application Ser. No. 15/944,868, filed Apr. 4, 2018, which claims priority to U.S. Provisional Patent Application No. 62/481,914 filed Apr. 5, 2017, the contents of which are hereby incorporated by reference in their entirety.

BACKGROUND

This disclosure relates generally to building structure hardware and methods employed for tying a member to a support structure under tension. More particularly, preferred versions of the disclosed embodiments relate to hardware and methods for tying deck joists or elongated wood components to a principal support structure such as, for example, a sill, a top plate or a structural component.

In applications to which the present disclosure relates, a proper installation of building materials requires that a secondary structure (for example, an elongate deck joist) be connected under tension to a principal support structure. There are numerous construction configurations to which the tension tying system may relate such as, for example, tying a deck joist to a principal support structure, tying one floor to a second floor, tying a post to a support structure and numerous other applications wherein installing an assembly, which is capable of connecting one member to another member under a high tension and which may be easily installed, is highly desirable. In addition, it is important that the connections provide a high degree of connection integrity over a long period of time.

Numerous tension tie assemblies for securing building members to one another exist, however, there are no known assemblies that allow increasing or decreasing the amount of tension force after initial attachment to the building structure. This can be a drawback in some building structures, as wooden building materials may shrink from a loss of moisture, warp or undergo other structural alterations over time that can impact the integrity of the connection provided by the tension tie assembly. Further, all known tension tie assemblies include rigid connection elements, which require precise measuring and careful installation of hardware on each of the building members to ensure that the tie elements can be aligned for connection. Thus, it would be useful to provide an adjustable tension tie assembly that can be tightened to increase the tension force experienced by the assembly or loosened to decrease the tension force experienced by the assembly after it is attached and without detaching from to the respective building members. It would furthermore be useful to provide a tension tie assembly that is attachable at a variety of different angles and which does not require precise alignment.

SUMMARY

In one embodiment, an assembly for tying a first building member to a second building member under tension includes a first anchor member and a second anchor member. A tie member is connectable under tension with said first anchor member and second anchor member, and the amount of tension on the tie can be increased or decreased after connection of the tie to the first and second anchor members.

An embodiment of an assembly for tying a first building member to a second building member under tension includes a first anchoring member connected to the first building member and a second anchoring member connected to the second building member. A tie has an elongate cable extending between a ball retained by the first anchoring member and a threaded stud retained by the second anchoring member. The tie is under tension between the first anchoring member and second anchoring member and the tension can be increased or decreased after connection of the tie to the first and second anchor members via threading of the threaded stud.

In another embodiment, a building system for maintaining a first building member and a second building member under tension includes a first building member with a second building member attached to the first building member. A first anchoring member is attached to the first building member and a second anchoring member is attached to the second building member. A tie has a ball on one end and a threaded stud on an opposite end with an elongate cable extending therebetween. The ball is retained by the first anchoring member and the threaded stud is retained by the second anchoring member with the cable extending therebetween under tension.

In another embodiment, a building system for maintaining a first building member and a second building member under tension comprises a first building member and a second building member attached to the first building member. A first anchoring member is attached to the first building member and a second anchoring member is attached to the second building member and provides a through opening. A tie has a ball on one end and a threaded stud on an opposite end and an elongate cable extending therebetween. The ball is retained by the first anchoring member in a socket allowing the ball to rotate relative to the first anchoring member and the threaded stud extends through the through opening with a threaded nut carried on a distal end and the cable extending therebetween under tension. The tension on the cable is adjustable via rotation of the nut along the threaded stud.

BRIEF DESCRIPTION OF THE DRAWINGS

The inventive embodiments will be described with reference to the drawings wherein like numerals indicate like elements throughout.

DETAILED DESCRIPTION

Figure 1:
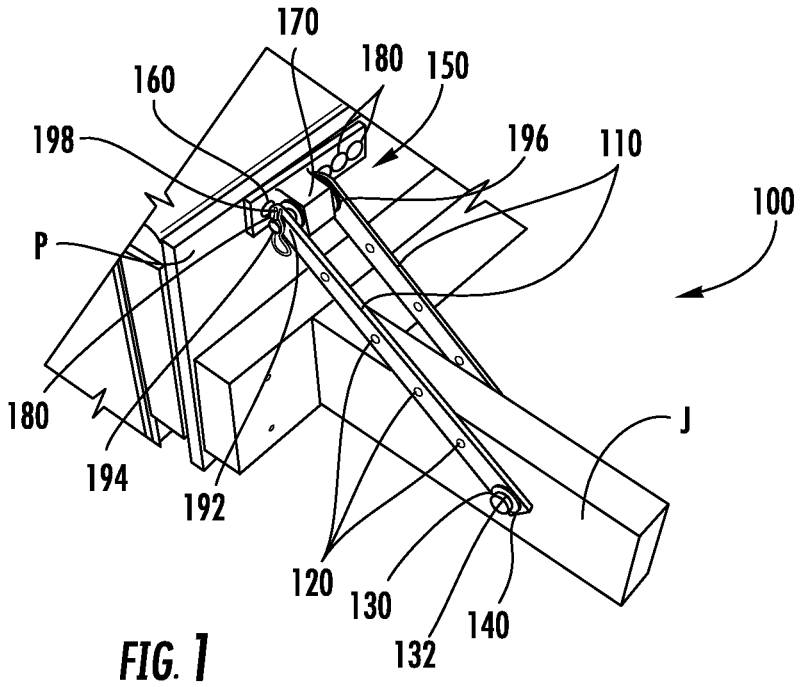
FIG. 1 is a perspective view of a first tension tie assembly installed for connecting between a pair of representative structures.

Among the benefits and improvements disclosed herein, other objects and advantages of the disclosed embodiments will become apparent from the following wherein like numerals represent like parts throughout the several figures. Detailed embodiments of an adjustable cleat and system for use with fascia are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "In some embodiments" and "in some embodiments" as used herein do not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

With reference to the drawings wherein like numerals represent like parts throughout the several figures, several embodiments of a tension tie assembly (100, 200, 300, 400) connect various structures under tension. Preferred installations to which the various assemblies have application, relate to joists which tie in with a principal support structure such as tying a deck support joist to a principal structure or tying various structural members under tension for numerous other applications. For all of the disclosed tension tie assemblies, a connector is connected under tension with anchor structures disposed on each of the members to which the tension tie assembly connects. The tension forces are effectively distributed by the installed assemblies. Over an extended period of time, the connections maintain a high degree of connection integrity. Typically, multiple tension tie assemblies are employed for a given installation.

As will be described below, numerous anchor configurations may be employed. Some anchor configurations, such as disclosed in FIGS. 1, 2 and 4, involve drilling a bore through a support truss or joist and attaching the anchor members to the connecting structure by various hardware elements. Other anchor configurations involve fastening anchor brackets via fasteners to one or more of the structures which are connected under tension.

With reference to FIGS. 1-4, tension tie assemblies 100, 200, 300 and 400 are shown connecting a pair of representative structures under tension. One example of a representative structure is a deck joist J (partially illustrated) and a principal building structure P (partially illustrated for representational purposes). In each instance, the respective tie assembly provides a high tension tie-off between the structures which can be easily installed on the construction site as required.

With reference to FIG. 1, tension tie assembly 100 comprises a pair of elongated metal ties 110 which are substantially identical and may have a series of spaced openings 120. A throughbore is drilled into the joist J, and a bolt 130 is inserted through the bore and into an end opening of each of the ties 110. The bolt 130 has a head 132 and a shank which extends through the bore. The bolt 130 may have a washer 140 which is retained by the head 132 and engaged against each of the outside surfaces of the tie. A nut is threadably torqued at the end of the bolt to secure the ties 110 to the joist J. A sleeve (not illustrated) may be inserted into the joist throughbore and the bolt 130 inserted into the sleeve so that the sleeve circumscribes the bolt 130 intermediate the bolt and surface of the throughbore.

An anchor module 150 includes a plate 160 which mounts a protruding head 170 housing a throughbore. The plate 160 has a series of openings which receive fasteners 180 that are torqued to secure the plate to the principal structure P.

The throughbore receives a pin 194 which has a head and a shank which extends through the end openings of each of the ties and through the bore in the head so that the ties 110 are essentially disposed in parallel spaced relationship at opposite sides of the joist J. Washers 196 may be interposed between the head and the ties 110. One end of the pin preferably has a flange-like head, and the other has a diametral bore which receives a cotter pin 198. It will be appreciated that the tension tie assembly 100 can be relatively easily installed and provides a high degree of connecting integrity. Moreover, the tension tie assembly 100 allows a high degree of variation for installing, given the plurality of openings 120 spaced along the ties 110 and the pivoting relationship between the ties 110 and the protruding head 170 before final installation.

As shown, the tension on the ties 110 of the assembly 100 can be adjusted by utilizing different openings 120 positioned along the ties 110.

Figure 2:
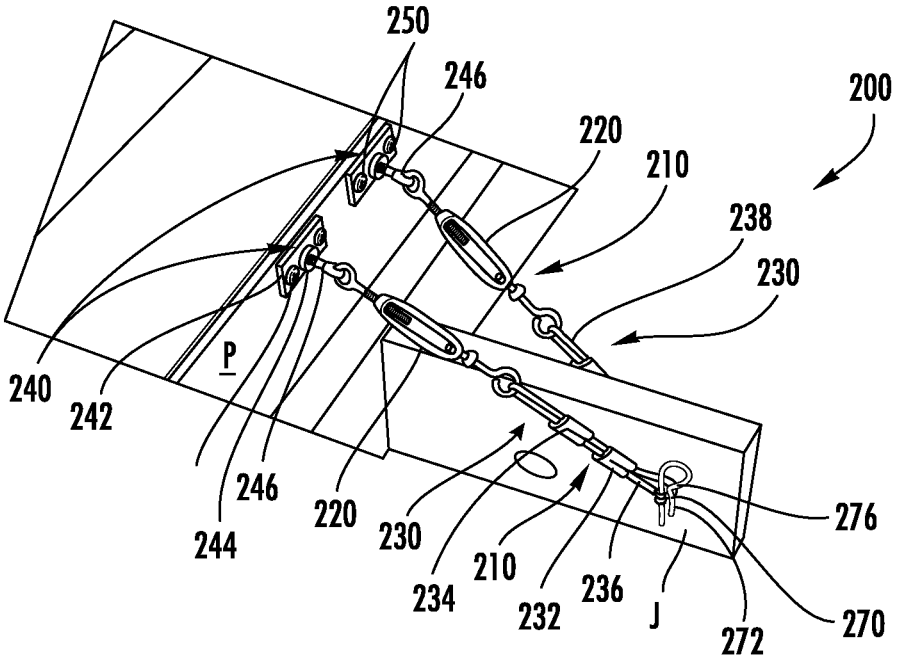
FIG. 2 is a perspective view of a second tension tie assembly installed for connecting between a pair of representative structures.

With reference to FIG. 2, another embodiment of the tension tie assembly 200 employs a pair of sub-assemblies 210 which mount at opposed sides of the joist J and each independently connect with anchor modules 240. The anchor module 240 has a plate 242 with a boss 244 that upwardly mounts an eyelet 246. A pair of openings are positioned one on each side of the eyelet and are adapted to receive fasteners 250. The fasteners are torqued through the openings and have a head which engages the plate 242 to secure the mounting bracket to the principal structure S.

Each sub-assembly 210 includes a turnbuckle 220 which, at one end, engages with the eyelet 246 and, at an upper end, engages a continuous cable loop 230. The loop 230 preferably has a pair of metal retainer bands 232 and 234 which form sub-loops 236 and 238, respectively.

A bolt 270 having an enlarged head at one side (not illustrated) extends through a bore of the joist J and projects outwardly at the opposing side. The bolt 270 has a diametral bore which receives a cotter pin 272. The sub-loop 236 of cable loop 230 extends about and is retained by the bolt 270. One or more washers 276 may be received in the bolt assembly to facilitate the securement of the cable loop to the support joist. The depicted tie assemblies 200 are substantially identical. It should be appreciated that the tension may be increased by rotating the turnbuckle 220 to threadably tighten each of the cable loops 236 and 238 to provide a desired tension. In a typical installation, the tie assembly 200 can be installed in a non-tension state with the ultimate tensioning being accomplished after the components have been installed.

This embodiment of the tension tie assembly 200 clearly provides a high degree of variability in terms of dimensions, angles and amount of tension on the building materials J and P. Moreover, the tension force on the tension tie assembly 200 can be adjusted at any time after installation to account for structural changes in the building materials, such as for example, tightening after wood shrinkage.

Figure 3:
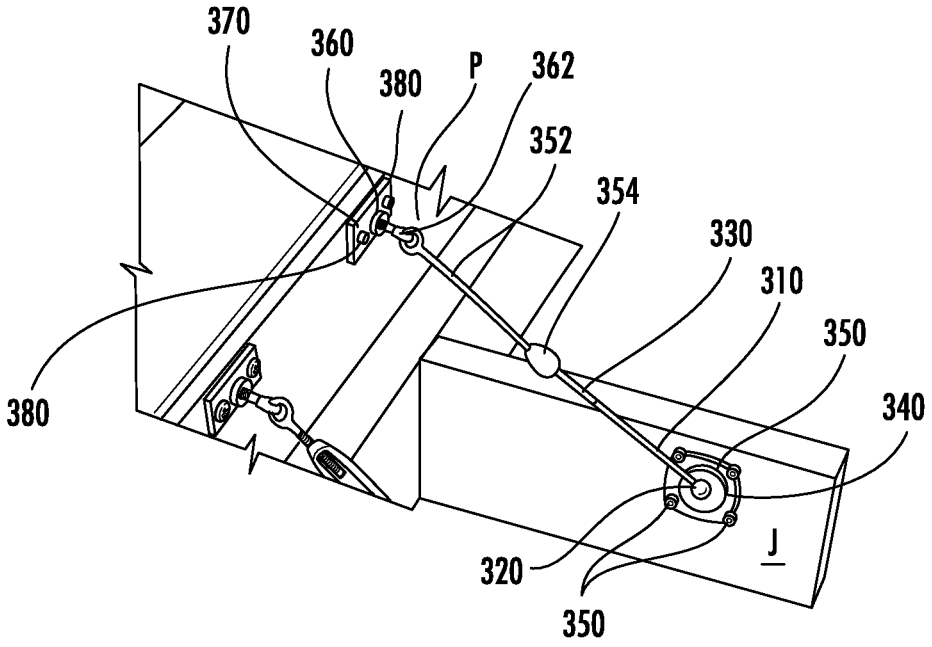
FIG. 3 is a perspective view of a third embodiment of a tension tie assembly employed for connecting between a pair of representative structures.

With reference to the embodiment shown in FIG. 3, the tension tie assembly 300 is constructed from an aircraft cable 310 or similar cable which, at one end, has a ball 320 and at the other end, has an integral threaded stud 330. The cable 310 with ball 320 seen in most clearly in isolation in FIG. 8. A swage plate 340 receives the ball and is mounted to the side of the joist by fasteners 350. Attachment of the ball 320 in the swage plate 340 as well as the moderately compliant properties of the cable 310 provide variability in the angular relationship of the cable 310 to the joist J. The threaded stud 330 is threadably received in a nut 354 extending from a rod 352. The rod 352 is anchored by a central head 362 of a mounting bracket 360. The bracket 360 includes a plate 370 with openings which are secured to the principal structure P by means of a pair of fasteners 380. Tightening of the thread increases the tension of the connection to a desired level.

Similar to the previous embodiment of the tension tie assembly 200, the tension tie assembly 300 can be installed in a non-tensioned state and then tightened to a desired tension by threading the stud 330 into the nut 354. The assembly 300 can similarly be tightened or loosened to increase or decrease tension force at a later time after initial installation.

Figure 4:
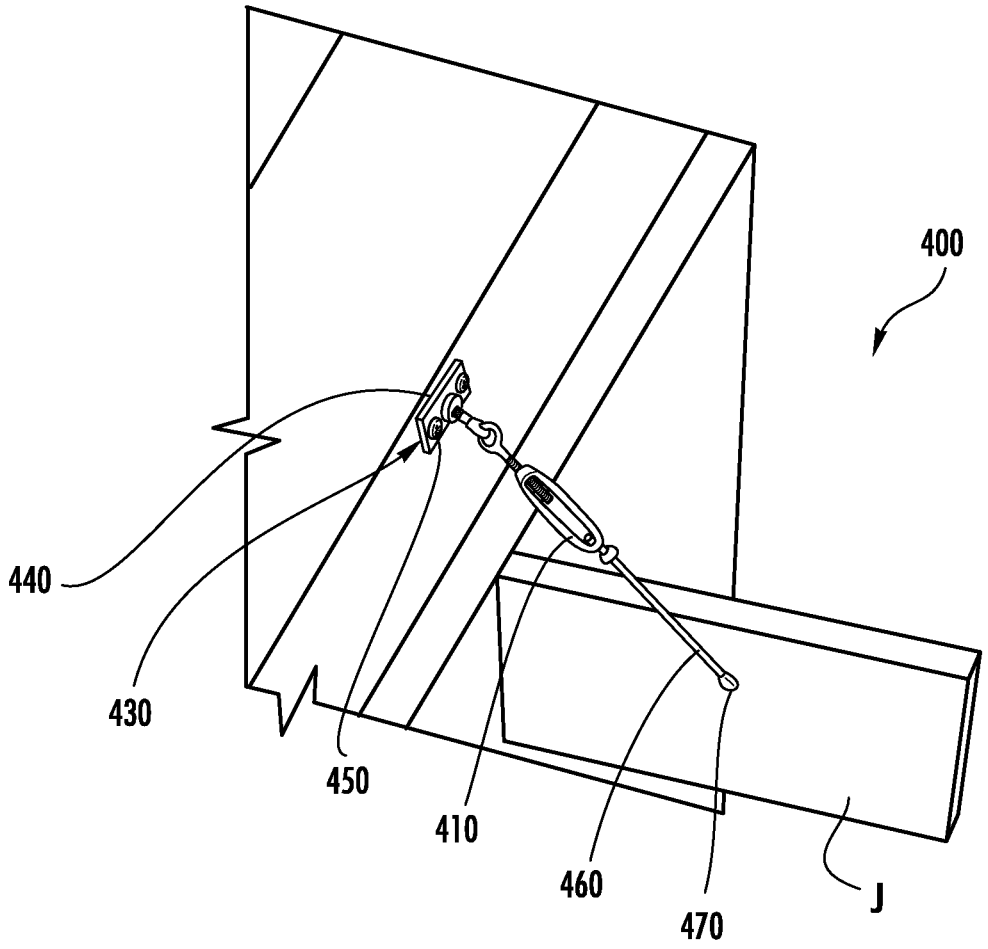
FIG. 4 is a fourth embodiment of a tension tie assembly employed for connection between a pair of representative structures.
Figure 9:
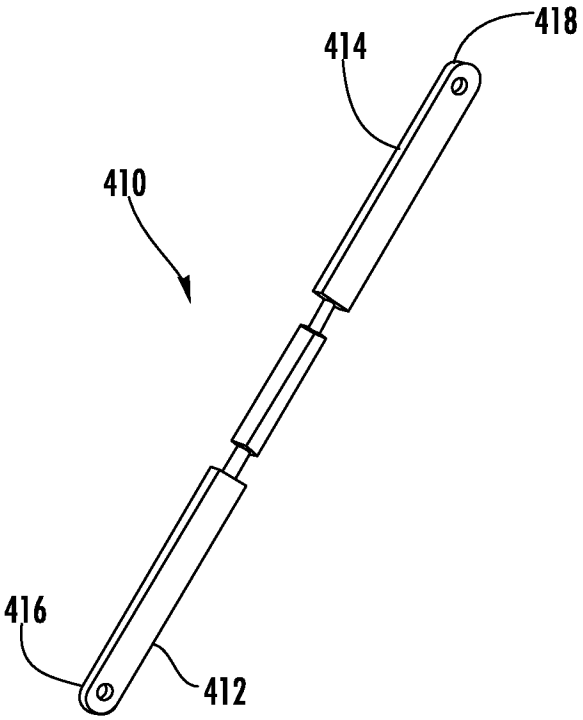
FIG. 9 is a perspective view of a turnbuckle connector employable in connection with a tension tie connector assembly.

With reference to FIG. 4, the embodiment of the tension tie assembly 400 includes a turnbuckle 410 having opposed ends 412 and 414 with respective openings 416 and 418, respectively (see FIG. 9). End 412 is secured by connecting the opening 416 with a mounting bracket 430. The mounting bracket 430 has a plate 440 with a pair of openings which receive fasteners for 450 securing the bracket to the principal support structure P.

The opposed end 414 of the turnbuckle 410 connects with a cable 460 connected through opening 418 and is passed through a sleeve 470 mounted in a bore of the support joist J. The opposed end of the cable has a threaded stud (not illustrated) which is secured by a nut (not illustrated) at an opposed side of the joist J. Tension in the tie assembly 400 may be accomplished by threadably engaging and rotating the turnbuckle 410 and/or by torqueing the nut. It will be appreciated that the tie-in tension of the tie assembly is implemented after the installation. This embodiment of the assembly 500 can be referred to as somewhat of a hybrid between the embodiments of the assembly 200 and 300, combining tension adjustability via the turnbuckle 410 in combination with the angular adjustability provided by the cable 460. Like previous embodiments, the assembly 400 can be adjusted after installation by threading the turnbuckle 410 to increase or decrease tension force.

Figure 5A:
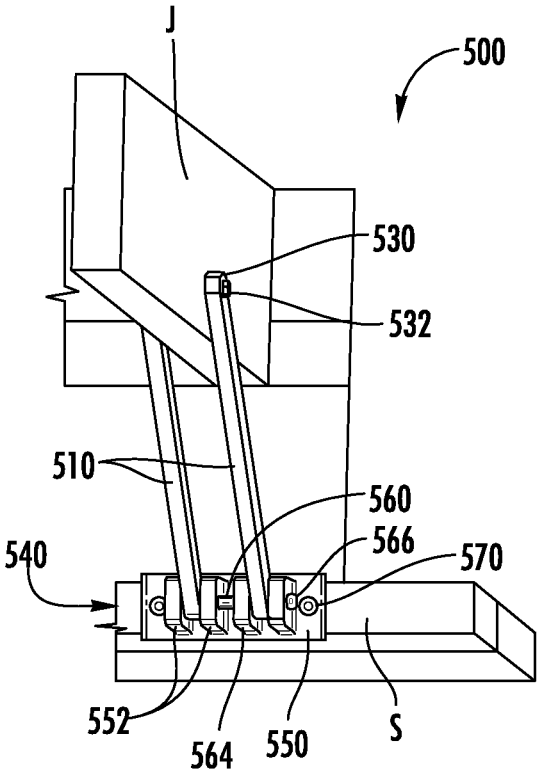
FIGS. 5A and 5B are perspective views of a tension tie assembly installed between a sill and a joist.
Figure 5B:
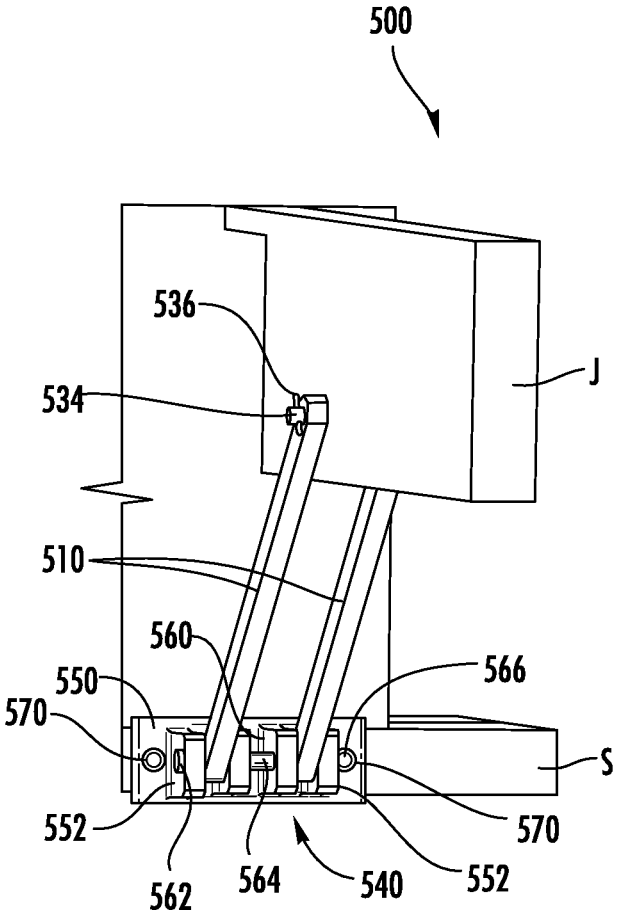
Figure 10:
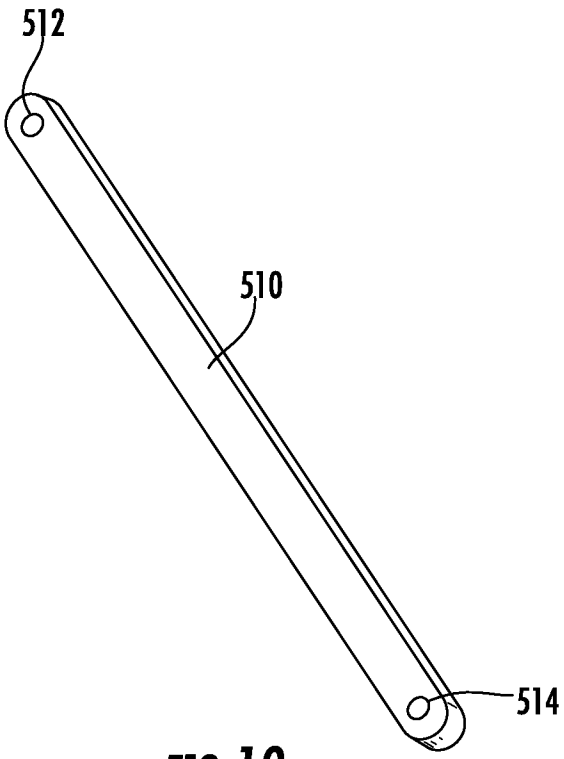
FIG. 10 is a perspective view of a connector employed in the assembly of FIGS. 5A and 5B.

With reference to FIGS. 5A and 5B, a tension tie-in assembly 500 implements a connection between a sill S and a joist J. A pair of substantially identical, rigid heavy-duty struts 510 are disposed on opposite sides of the joist J. Opposed ends of the struts have openings 512 and 514 (see FIG. 10).

A bolt 530 having a head 532 and a shank extends through the strut openings 512 and a bore of the joist J and projects outwardly through the opening 512 of one of the struts. A pin 536 is inserted into a diametral bore at the end of the bolt 530 to secure the struts 510 in place. Bolt head 532 engages the opposite strut.

An anchor module 540 comprises a plate 550 which mounts two pairs of ears 552 having aligned openings. A bolt 560 having a flange-like head 562 and a shank 564 extends through the openings and through the openings in the struts and is secured by a pin 566. The plate 550 is mounted to the edge of the sill S by a pair of fasteners 570. The tie assembly 500 employs a pair of heavy-duty metal struts which are disposed in parallel spaced fashion and are initially essentially pivotally mounted to both the anchor plate 550 secured to the sill S and through an opening in the support joist J.

Figure 6A:
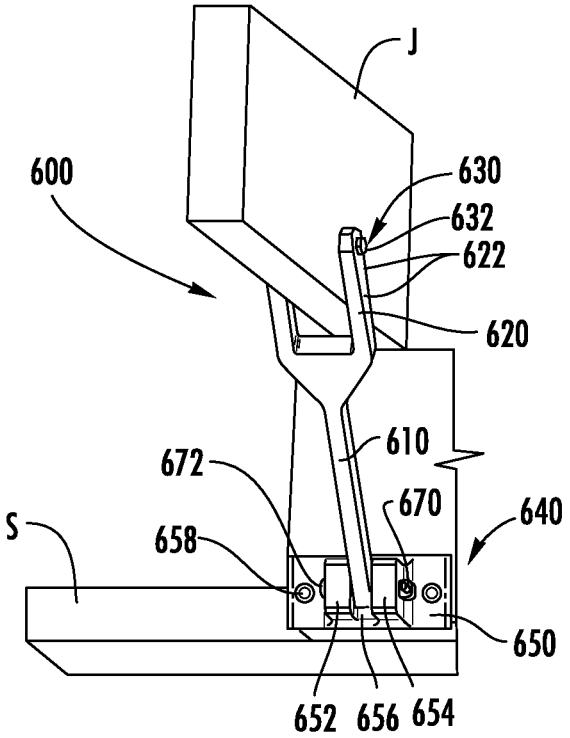
FIGS. 6A and 6B are perspective views of a tension tie yoke assembly connecting between a sill and a joist.
Figure 6B:
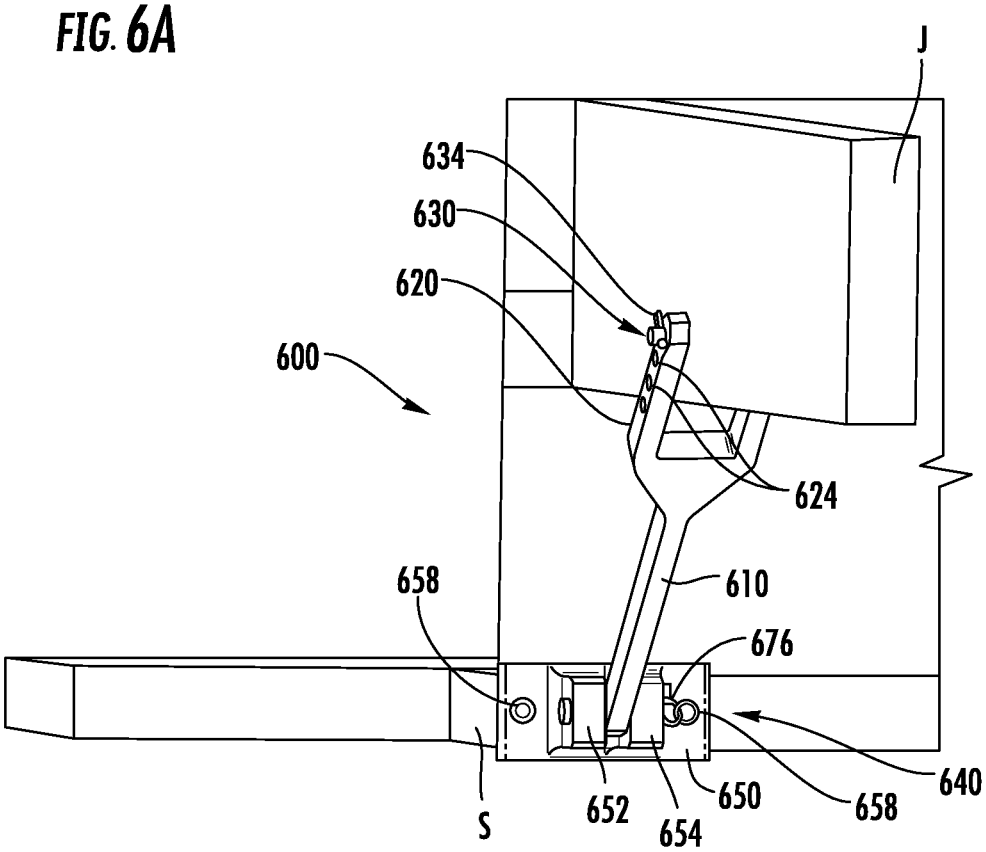

With reference to FIGS. 6A and 6B, a tension tie assembly 600 connects between a joist J and a sill S. A tie bar 610 is forked at one end to form a yoke 620 which is generally dimensioned to saddle over opposed sides of the joist. A bore is formed through the joist J. The forked ends include spaced aligned openings 622 and 624.

A pin 630 having a head 632 is inserted through one opening 622 of one side of the fork through the joist to the aligned opening 624 on the other side of the fork and extends outwardly. A cotter pin 634 is inserted into a diametral transverse bore of the pin 630.

A bracket 640 has a mounting plate 650 with a pair of protruding anchoring ears 652, 654 which have aligned openings and define an intermediate slot 656. The mounting plate 650 is secured to the sill S by fasteners 658. A second pin 670 having a head 672 extends through aligned openings of the ears 652, 654 and an opening at the end of the support bar 610 received in slot 556 and projects outwardly from the opposed side of the other ear. A cotter pin 676 is inserted into a diametral bore at the end of the pin 670 for retaining the pin to the anchoring bracket 640. It will be appreciated that the foregoing provides a means of providing a tension tie-in of high integrity which connects between a projecting joist J and the edge of the sill plate S. Naturally, other connections may also be provided.

Figure 7A:
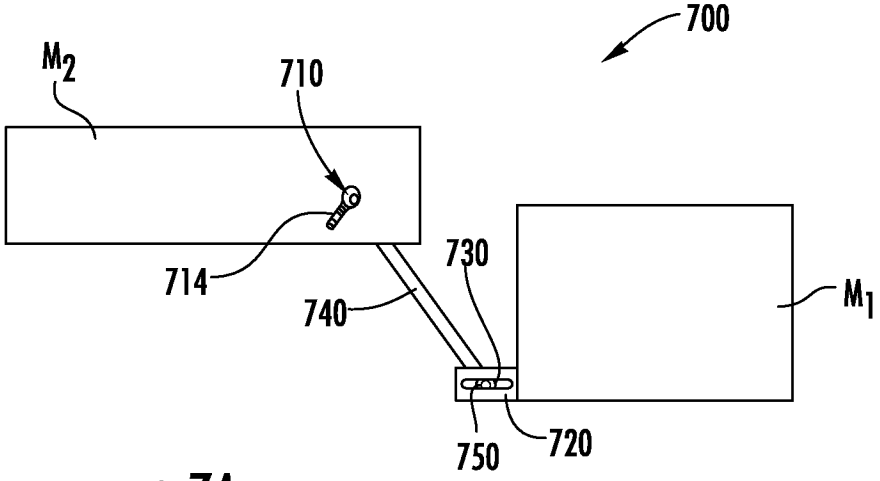
FIGS. 7A and 7B are side views, partly in schematic, illustrating an eccentric attachment under tension connecting a pair of representative members.
Figure 7B:
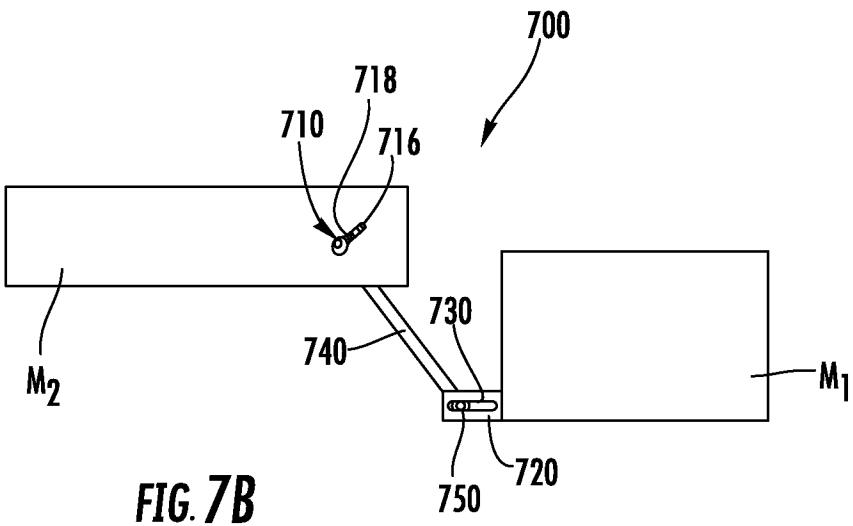
Figure 11:
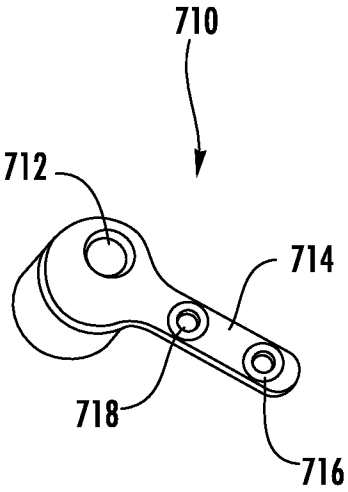
FIG. 11 is a perspective view of an eccentric bushing employed in the eccentric attachment assemblies of FIGS. 7A and 7B.
Figure 13:
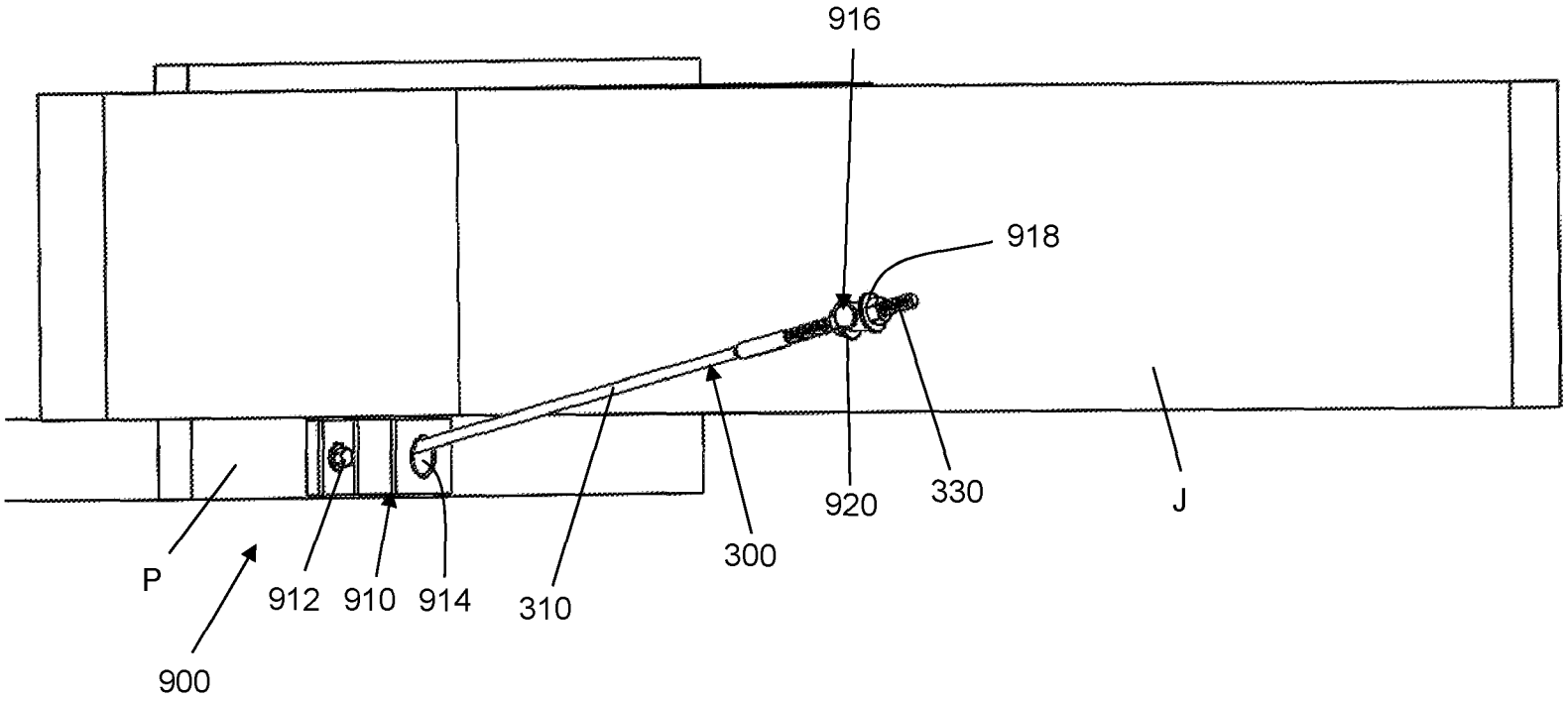
FIG. 13 shows a tension tie assembly installation that employs the sub-assembly of FIG. 8.

With reference to FIGS. 7A and 7B, an eccentric tie assembly 700 employs an eccentric bushing 710 (FIG. 11) to implement the tension tie-in. A bracket 720 is mounted to the end of a member $M_1$. The bracket has an elongated slot 730.

A rigid tie bar 740 has openings at opposed ends. Bar 740 may be similar to strut 510. A fastener 750 extends through the opening and through the slot to secure the bar 740 to the first member $M_1$.

A second opposed opening in bar 740 receives a fastener inserted through an opening 712 in the eccentric bushing 710 to connect the bar 740 to the second member $M_2$. The opening 712 is eccentrically located in the bushing. The bushing 710 includes a projecting handle or crank 714 which includes a pair of openings 716 and 718. The tension is implemented by rotating the crank 714 of the eccentric bushing to provide tension to the connector bar 740 and then fastening the eccentric bushing to the second member $M_2$ at a given position by driving a fastener (not illustrated) through one or more of the bushing openings 716, 718 to secure the bushing at the preferred angular position.

Figure 12:
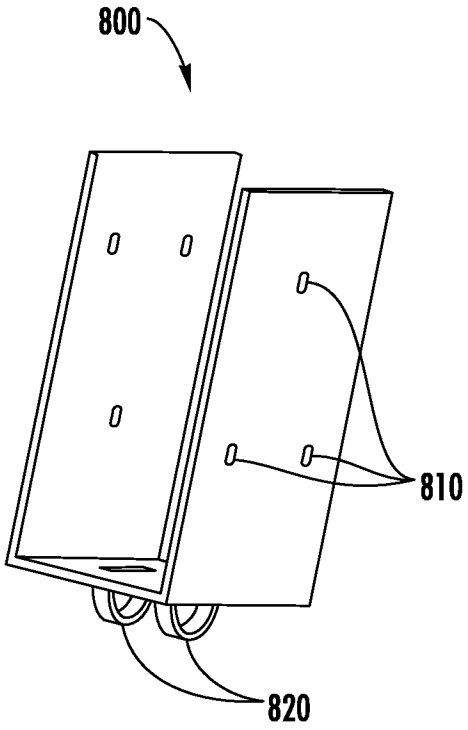
FIG. 12 is a perspective view of a saddle bracket employable in a tension tie assembly.

With reference to FIG. 12, a tension tie connection may also be implemented by a saddle bracket 800. The saddle bracket 800 has a bent U-shaped structure configured to saddle over a joist or other structure. The bracket 800 has openings 810 to receive fasteners for anchoring the bracket in place. The bracket has an enlarged pair of integral loops 820 for receiving a bolt, a pin or other fastener.

Figure 8:
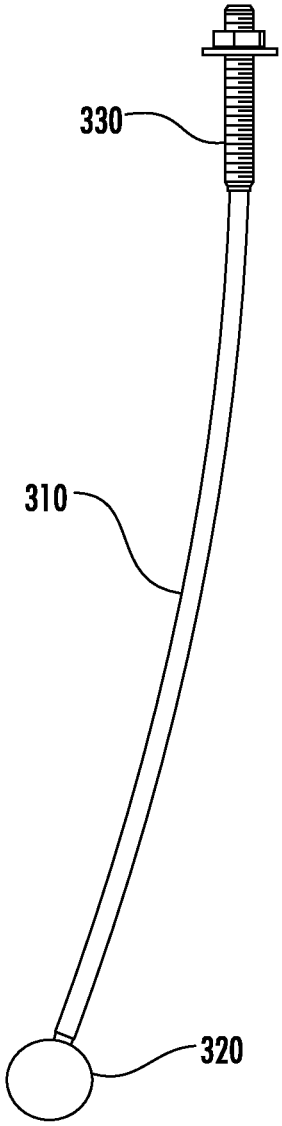
FIG. 8 is a perspective view of a connector sub-assembly employed in the assembly of FIG. 3.
Figure 14:
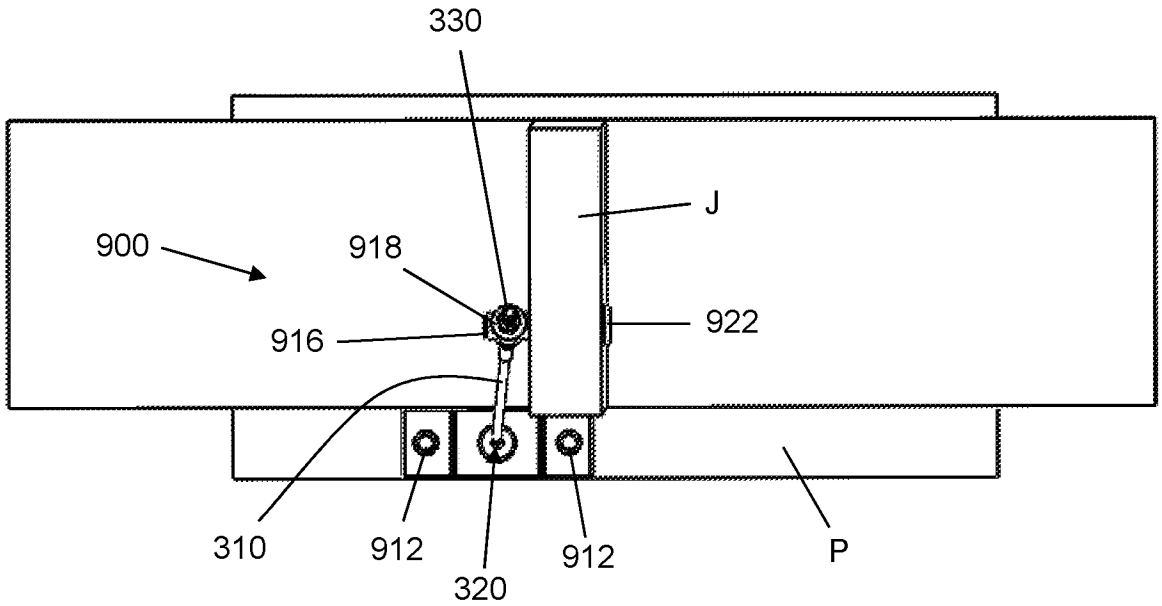
FIG. 14 is a different view of the installation of FIG. 13.
Figure 15:
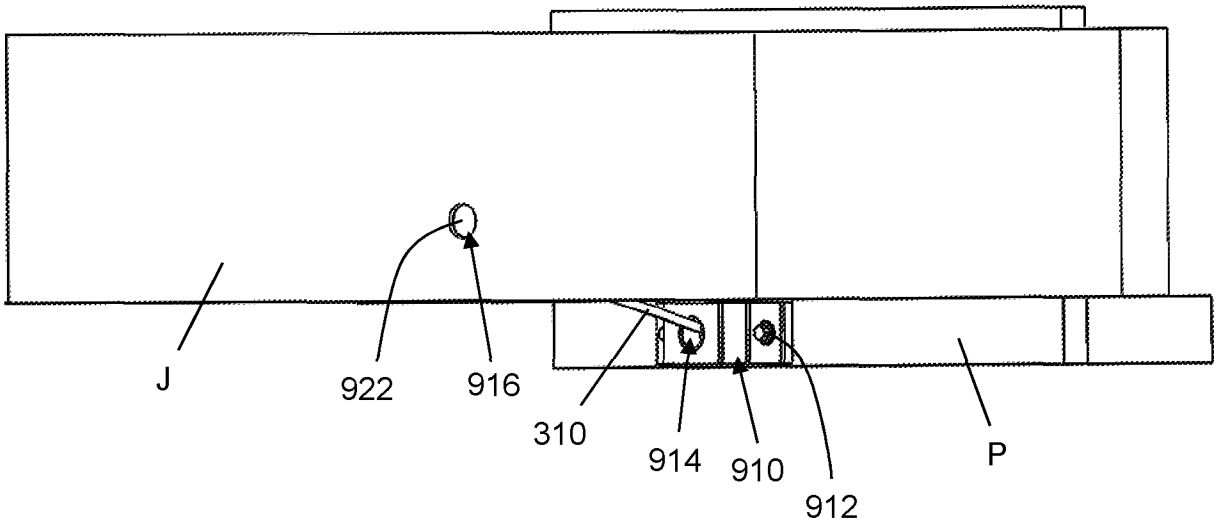
FIG. 15 is a view of the installation of FIG. 13 from the opposite side from FIG. 13.
Figure 16:
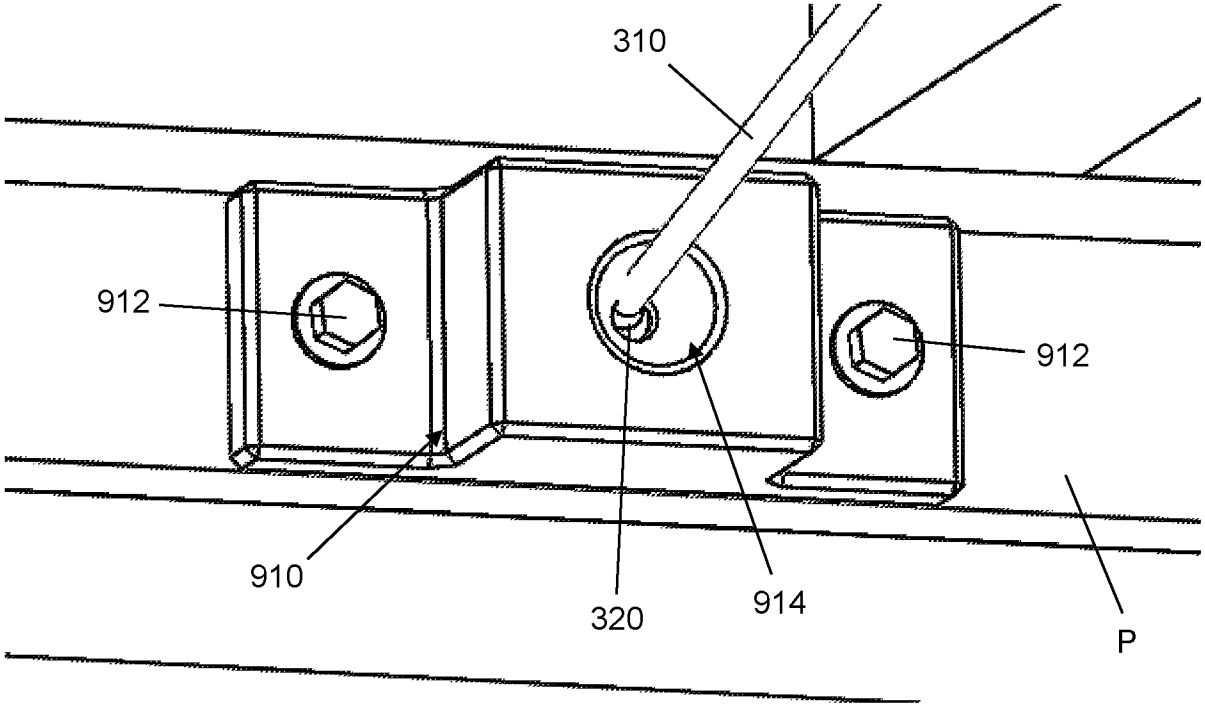
FIG. 16 is an enlarged view of one end of the installation of FIG. 13.
Figure 17:
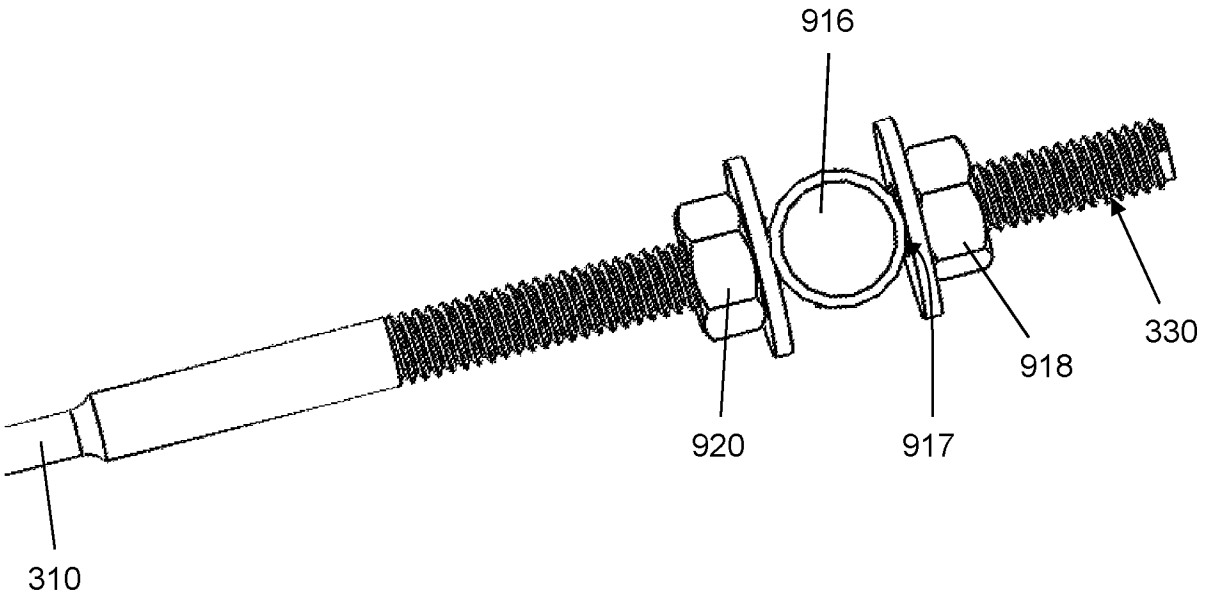
FIG. 17 is an enlarged view of the other end of the installation of FIG. 13.
Figure 18:
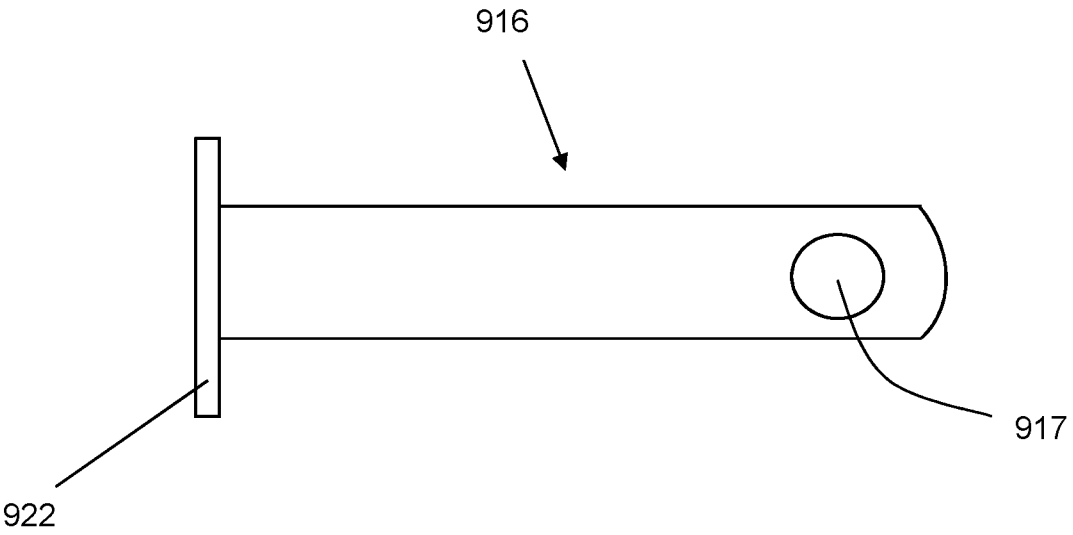
FIG. 18 shows an exemplary pin element employed in the assembly of FIG. 13.

FIGS. 13-17 depict views of an installation of an assembly 900 that employs the tension tie sub-assembly 300 with cable 310 that carries a ball 320 on one end and a threaded stud 330 on the other end, as shown in FIG. 8. A first anchoring member, such as a swage bracket 910, is fixed to the principal structure P, typically at a lower end via fasteners 912 with the ball 320 from the sub-assembly 300 maintained. When installed, the cable 310 extends from the outside through an opening 914 in the bracket to the ball-retaining socket in the swage bracket 910. A pin 916 with lateral bore 917 proximate its distal end extends through a through hole in the joist J with the bore 917 exposed on one side of the joist J. In this embodiment, the pin 916 includes an outward annular flange 922 on its proximal end that creates an abutment surface against the opposite side of the joist J (see FIGS. 14 and 15). An exemplary pin 916 is shown in isolation in FIG. 18. In the installed assembly 900, the threaded stud 330 is positioned extending through the lateral bore 917 and secured at least at its distal end via a nut 918. As shown, the assembly can utilize a secondary nut 920 on the opposite relative side of the threaded stud 330, thus sandwiching the pin 916 with the distal nut 918 for additional stability. As shown, additional hardware may be employed, such as washers. As seen in FIGS. 14, 15 and 18, the proximal end of the pin 916 carries an outwardly extending annular flange 922 that abuts tightly against a side of the joist J. Although not shown in the drawings, the flange 922 may carry a series of teeth or an abrasive surface for penetrating the joist surface and/or further hardware, such as fasteners, may be employed to assist in securely attaching the pin 916 to the joist J.

This embodiment of the tension tie assembly 900 carries several advantageous characteristics. For example, the ball 320 in socket 914 arrangement with the swage bracket 910 on one end as well as the flexibility of the cable 310 allows adjustment of the angle of extension of the cable 310 from the bracket 910 and thus, provides significant adjustability of the positioning of the pin 916 and stud 330 on the opposite end. Installers need not worry about overly precise measurements and precise installation of the pin 916 and/or bracket 910, since the angle of extension of the line 300 relative to the bracket 910 is fully adjustable. Further, the assembly 900 allows periodic tightening after initial installation simply by tightening the nut 918. For example, in many wooden building structures, a natural shrinkage of the building materials occurs due loss of moisture content of the wood which results in a loosening of the fitting fixtures and possible movement of the building materials. The assembly 900 is configured to allow periodic tightening to accommodate this shrinkage phenomenon.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. An assembly for tying a first building member to a second building member under tension comprising:

a first anchoring member connected to the first building member;

a second anchoring member connected to the second building member; and a tie comprising an elongate cable extending between a ball retained by the first anchoring member and a threaded stud retained by the second anchoring member, wherein the tie is under tension between the first anchoring member and second anchoring member and said tension can be increased or decreased after connection of the tie to the first and second anchor members via threading of the threaded stud, and the second anchoring member is a pin having a bore extending therethrough and the stud is retained within the bore.

2. The assembly of claim 1, wherein the stud extends through the bore and carries a distal threaded nut on a distal end.

3. The assembly of claim 2, wherein the tension can be increased or decreased via threading the nut in opposite directions.

4. The assembly of claim 1, wherein the first anchoring member is a swage bracket that retains the ball in a socket.

5. The assembly of claim 1, wherein the ball is rotatable relative to the first anchoring member when retained thereby.

6. The assembly of claim 1, wherein the second building member is a joist extending from the first building member, wherein the joist has two opposite sides and the pin extends through the joist from a first side to the opposite second side of the joist with the bore exposed on the second side, and the threaded stud is positioned within the bore.

7. The assembly of claim 6, wherein the stud extends through the bore and carries a nut threaded on a distal end that anchors the stud to the pin.

8. The assembly of claim 7, wherein the pin has an outwardly extending annular flange on an end opposite from bore that abuts the first side of the joist.

9. A building system for maintaining a first building member and a second building member under tension comprising:

a first building member;

a second building member attached to the first building member;

a first anchoring member attached to the first building member;

a second anchoring member attached to the second building member; and a tie having a ball on one end and a threaded stud on an opposite end with an elongate cable extending therebetween, wherein the ball is retained by the first anchoring member and the threaded stud is retained by the second anchoring member with the cable extending therebetween under tension, and the second anchoring member is a pin that extends through the second building member and comprises a hole on one end of the second building member that is engaged with the stud.

10. The assembly of claim 9, comprising a nut with a threaded opening threaded at a distal end of the stud and abutting the second anchoring member to secure the stud.

11. The assembly of claim 10, wherein tension in the tie is adjusted via threading of the nut and rod.

12. The assembly of claim 9, wherein the first anchoring member is a swage bracket that defines a socket that retains the ball in a rotational relationship.

13. The assembly of claim 9, wherein the first anchoring member is a swage bracket that retains the ball in a rotational relationship and the second anchoring member is a pin that defines a bore that receives the threaded stud, whereby tension in the tie is adjustable via threading of the stud.

14. The assembly of claim 13, wherein the stud extends through the pin with a distal end exposed and carries a nut threaded on the distal end, and wherein tension is adjustable via threading of the nut on the stud in opposite directions to loosen or tighten tension.

15. A building system for maintaining a first building member and a second building member under tension comprising:

a first building member;

a second building member in engagement with the first building member;

a first anchoring member attached to the first building member;

a second anchoring member comprising a pin attached to the second building member and providing a through opening; and a tie having a ball on one end and a threaded stud on an opposite end with an elongate cable extending therebetween, wherein the ball is retained by the first anchoring member in a socket allowing the ball to rotate relative to the first anchoring member and the threaded stud extends through the through opening of the pin and carries a threaded nut on a distal end with the cable extending therebetween under tension, and the tension on the cable is adjustable via rotation of the nut along the threaded stud.

16. The building system of claim 15, wherein second building member has a first side and an opposite second side, and the pin has an outwardly extending annular flange on an end opposite from bore that abuts the first side of the joist with the bore exposed on the second side.

17. The building system of claim 16, wherein the first side defines a first surface and a portion of the flange penetrates the first surface.

18. The building system of claim 9, wherein second building member has a first side and an opposite second side, and the pin has an outwardly extending annular flange on an end opposite from bore that abuts the first side of the joist with the bore exposed on the second side.

19. The building system of claim 18, wherein the first side defines a first surface and a portion of the flange penetrates the first surface.

20. The building system of claim 8, wherein the first side defines a first surface and a portion of the flange penetrates the first surface.

* * * * *